US005947085A

United States Patent [19]

Deal

[11] Patent Number: 5,947,085

[45] Date of Patent: Sep. 7, 1999

[54] METHOD AND DEVICE FOR AUTOMATICALLY CONTROLLING THE FLUID INTAKE OF AN ENGINE

[76] Inventor: Richard E. Deal, 614 S. Moore, Algona, Iowa 50511

[21] Appl. No.: 08/863,780

[22] Filed: May 27, 1997

[51] Int. Cl.[6] ..... F02D 3/00

[52] U.S. Cl. ..... 123/389

[58] Field of Search ..... 123/389, 391, 123/332

[56] References Cited

U.S. PATENT DOCUMENTS

| | | | |
|---|---|---|---|
| 782,244 | 2/1905 | Haydon | 123/389 |
| 838,754 | 12/1906 | Smith | 123/389 |
| 1,348,956 | 8/1920 | Pokorny, Jr. | 123/332 |
| 1,823,346 | 9/1931 | Burdick | 123/332 |
| 2,373,381 | 4/1945 | Chamberlain . | |
| 3,802,401 | 4/1974 | Nutten et al. . | |
| 3,916,853 | 11/1975 | Lombard . | |
| 3,949,716 | 4/1976 | Liu . | |
| 4,044,077 | 8/1977 | Gupta . | |
| 4,375,801 | 3/1983 | Eckman . | |
| 4,384,559 | 5/1983 | Tchang et al. . | |
| 4,419,972 | 12/1983 | Hattori et al. . | |
| 5,102,054 | 4/1992 | Halvorsen . | |
| 5,133,319 | 7/1992 | Ikeda et al. . | |
| 5,216,610 | 6/1993 | Douta et al. . | |

FOREIGN PATENT DOCUMENTS

| | | |
|---|---|---|
| 1392048 | 1/1973 | United Kingdom . |

*Primary Examiner*—Tony M. Argenbright
*Assistant Examiner*—Arnold Castro
*Attorney, Agent, or Firm*—Zarley, Thomte, Vorhees & Sease

[57] ABSTRACT

A device for automatically adjusting fluid flow into an engine intake includes a body member adapted to mount upstream of the engine intake and having a fluid passage therethrough and an aperture therein intersecting the fluid passage, a plate slidably insertable into the aperture and having a bore therethrough corresponding to and registerable with the fluid passage when the plate is inserted in the body member, and a variable orifice operatively disposed in the bore and thereby defining an opening area which is automatically variable and dependent on fluid throw through the orifice demanded by the engine at a given RPM. This device can be used to handicap one racer or to establish engine performance parity in racing vehicles by mounting the device between the carburetor and engine intake of each vehicle.

20 Claims, 5 Drawing Sheets

METHOD AND DEVICE FOR AUTOMATICALLY CONTROLLING THE FLUID INTAKE OF AN ENGINE

BACKGROUND OF THE INVENTION

The present invention relates to the fields of engines and motor sports. More particularly, this invention relates to a device for controlling, usually restricting, the flow of air/fuel mixture drawn by an engine. Such a device can be used to equalize engine performance among racers to make the competition more heavily dependent on the drivers' skill.

There are many different kinds of motor sports, including, but not limited to, the racing of automobiles, boats, airplanes, motorcycles and snowmobiles. Success in a race depends on at least two elements: the equipment and the skill of the driver. Unfortunately, in many motor sports the necessary equipment has become extremely costly to purchase and maintain. Often, races are won by the racing team with the most financial resources, not necessarily the most skillful drivers. Various racing regulations and engine specifications have been implemented in an attempt to make races more fair to all participants. Some races set limits on the cubic inches of displacement for engines in a given race. However, most of these measures are easily circumvented by racing teams who have the human resources, time and money to modify their engines in ways that are not regulated. The end result is that the races are becoming less competitive and therefore less interesting for the spectators.

In response, some racing associations have implemented rules which allow anyone in the same lap as the fourth place racer to claim or buy the engine from any of the top four finishing racers for a nominal price. The claim price is purposely set low, usually less than one-half the true cost of the engine. This is intended to discourage racers from investing an inordinate amount of money on their engines to obtain a competitive advantage which less wealthy racers cannot match. However, claiming another racer's engine is generally not considered an endearing gesture and claims are rarely exercised. When claims are rarely exercised, racers feel safe in investing more money in their engines, the races again become less competitive, and some drivers and fans will lose interest. When claims are frequently exercised, the drivers who invest heavily in their engines may also get discouraged and quit. Claiming regulations must strike a fine balance to avoid hurting the sport at either end. Another problem with claiming is that some drivers "sandbag" or purposely slow down or brake to avoid finishing in positions where their engines can be claimed. Such unusual moves on the race track can lead to collisions. Clearly, claim racing has not been a cure-all.

It is also known to rigidly mount a fixed orifice restrictor plate between the carburetor and intake manifold of an engine. However, such plates are inflexible and fail to equalize performance among relatively high performance (expensive) engines and lower performance (less expensive) engines. Fixed orifice restrictors also choke off the engine at high rpms and slows acceleration. This penalizes smaller motors because the larger motors are still able to draw in more fuel without being choked off. Thus, the desired equalizing effect is not achieved.

A flexible means and method are needed for controlling engine performance in a way which is effective and cannot be easily circumvented. Ideally, a device is needed to make a last minute across-the-board engine modification that will result in engine performance parity among the racers and reduce the likelihood of cheating. If such a device were installed immediately before the race, even the teams with considerable financial and human resources would not have the time to make engine modifications to circumvent the effects of the device.

Therefore, a primary object of the present invention is a provision of a means and method for automatically adjusting fluid flow at the intake of an engine.

A further object of the present invention is the provision of a device that will substantially equalize the engine performance of a group of the racers to make the race more competitive and dependent on the skill of the drivers.

A further object of the present invention is the provision of a fluid flow restrictor device which is easily insertable between the carburetor and intake manifold of an engine.

A further object of the present invention is the provision of a variable orifice shaped so as to minimize turbulence upstream of the orifice.

These and other objects will be apparent in the specification and claims which follow.

SUMMARY OF THE INVENTION

The present invention relates to a device for automatically adjusting fluid flow into an engine intake. The device includes a body member adapted to mount between the engine intake and the carburetor. The body member has one or more fluid passages therethrough and an aperture which intersects the fluid passages. The device also includes a plate which is slidably insertable into the aperture and the body member. The plate has one or more bores therethrough corresponding to and registerable with the fluid passages when the plate is inserted in the body member. The device further includes a variable orifice disposed in each bore. The variable orifice defines an opening area which is automatically variable. The opening area is dependent on the fluid flow demanded through the orifice by the engine at a given engine speed or RPM.

The variable orifice includes a sleeve mounted in the bore, a washer member having a central opening therein, a spring operatively interposed between the sleeve and the washer member, and a poppet mounted to one of the sleeve and washer member. The poppet is suspended inside the sleeve to define a substantially annular opening. The washer member can include a curved surface adjacent the central opening to decrease the turbulence upstream of the variable orifice. As more air is drawn through the air passage, the spring compresses to partially obstruct the bore with the poppet, thereby automatically limiting the air flow into the engine intake.

A method of establishing engine performance parity in racing vehicles during a race is also disclosed. The steps of the method include mounting a body member between the carburetor and the engine intake of each of the racing vehicles. Race officials then provide an identically equipped restrictor plate for insertion into the body member aperture of each of the racing vehicles. Each of the restrictor plates has one or more identical orifices disposed therein for registering with the fluid passages of the body member. When the orifices are identical automatic variable orifices, fluid flow into the engine intake is identically regulated for all engines in a particular race. Alternatively, race officials could provide different orifices so as to handicap only a particular car or group of cars in the race.

DETAILED DESCRIPTION OF THE PREFERRED EMBODIMENTS

Figure 1:
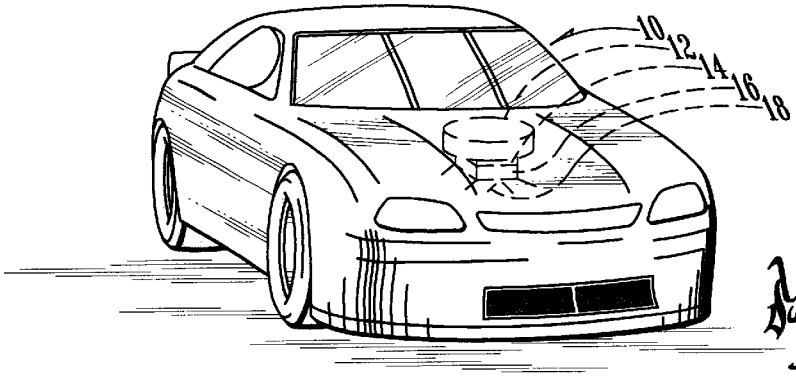
FIG. 1 is a perspective view of a race car equipped with the present invention.

The device of this invention automatically controls the fluid intake of an engine. The device provides a method of bringing engine performance parity to a plurality of motorized racing vehicles, such as the race car 10 shown in FIG. 1. However, it will be understood that the device and method of the present invention can be applied to almost any motorized vehicle, especially one having an internal combustion engine.

Figure 2:
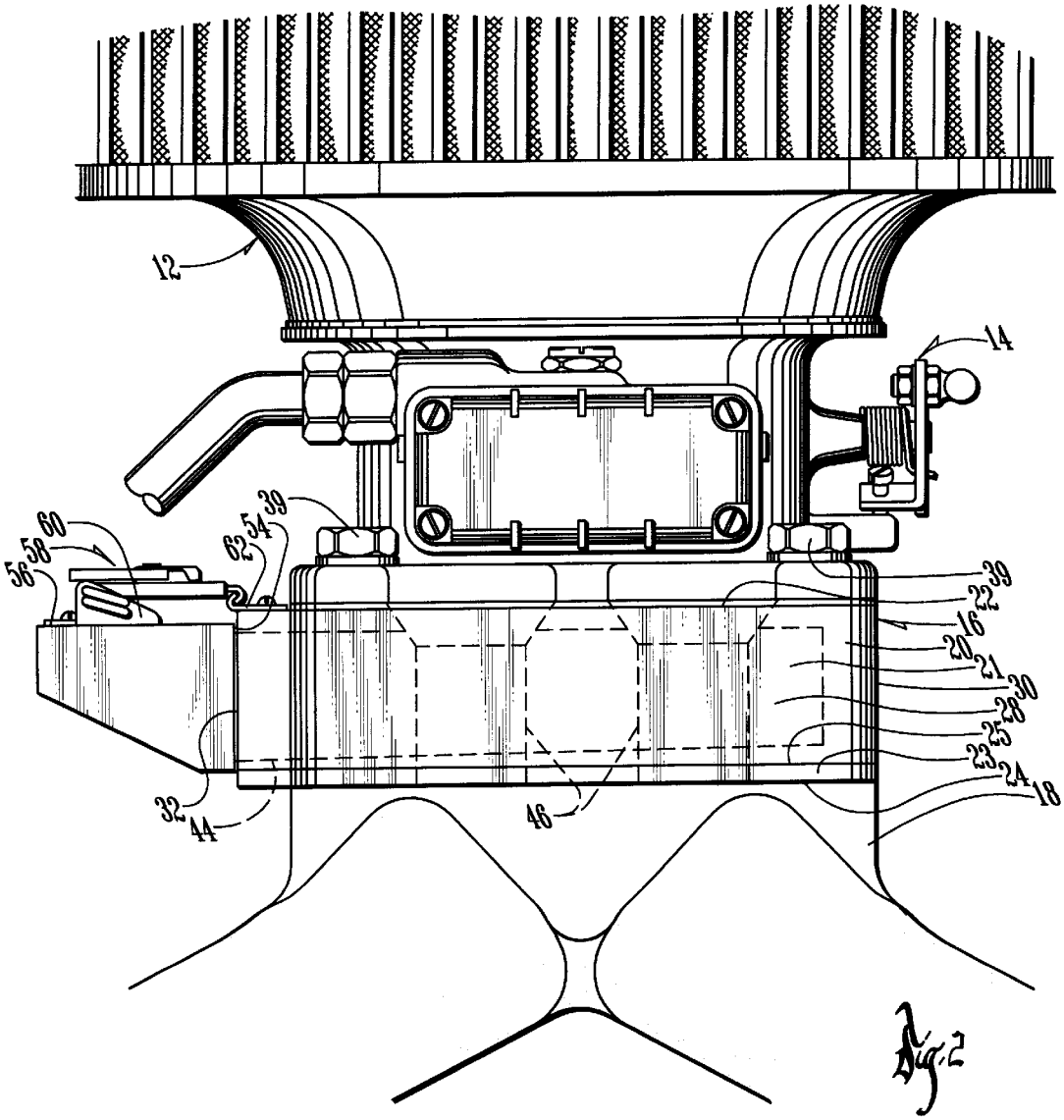
FIG. 2 is an enlarged perspective view of an engine intake area and carburetor of the race car shown in FIG. 1.

The engine (not shown) of the race car 10 requires or demands an air-fuel mixture for combustion. Air flows through an air filter 12 and a carburetor 14 mixes the fuel with the air (FIG. 2). In this invention, a restrictor device 16 is mounted between the carburetor 14 and the engine intake manifold 18.

Figure 3:
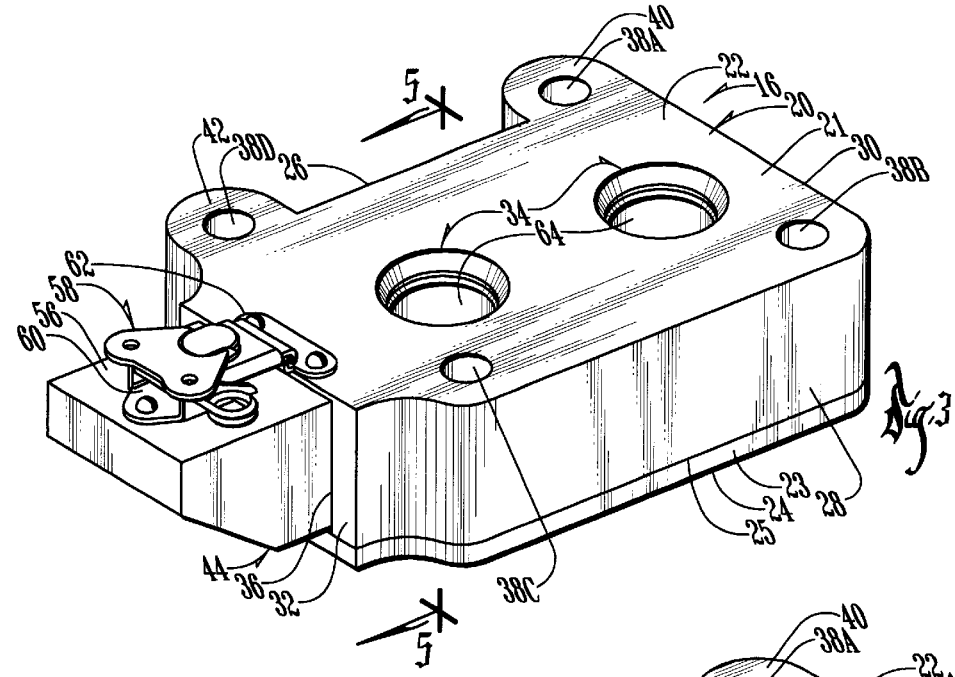
FIG. 3 is a perspective view of the restrictor device of the present invention.
Figure 4:
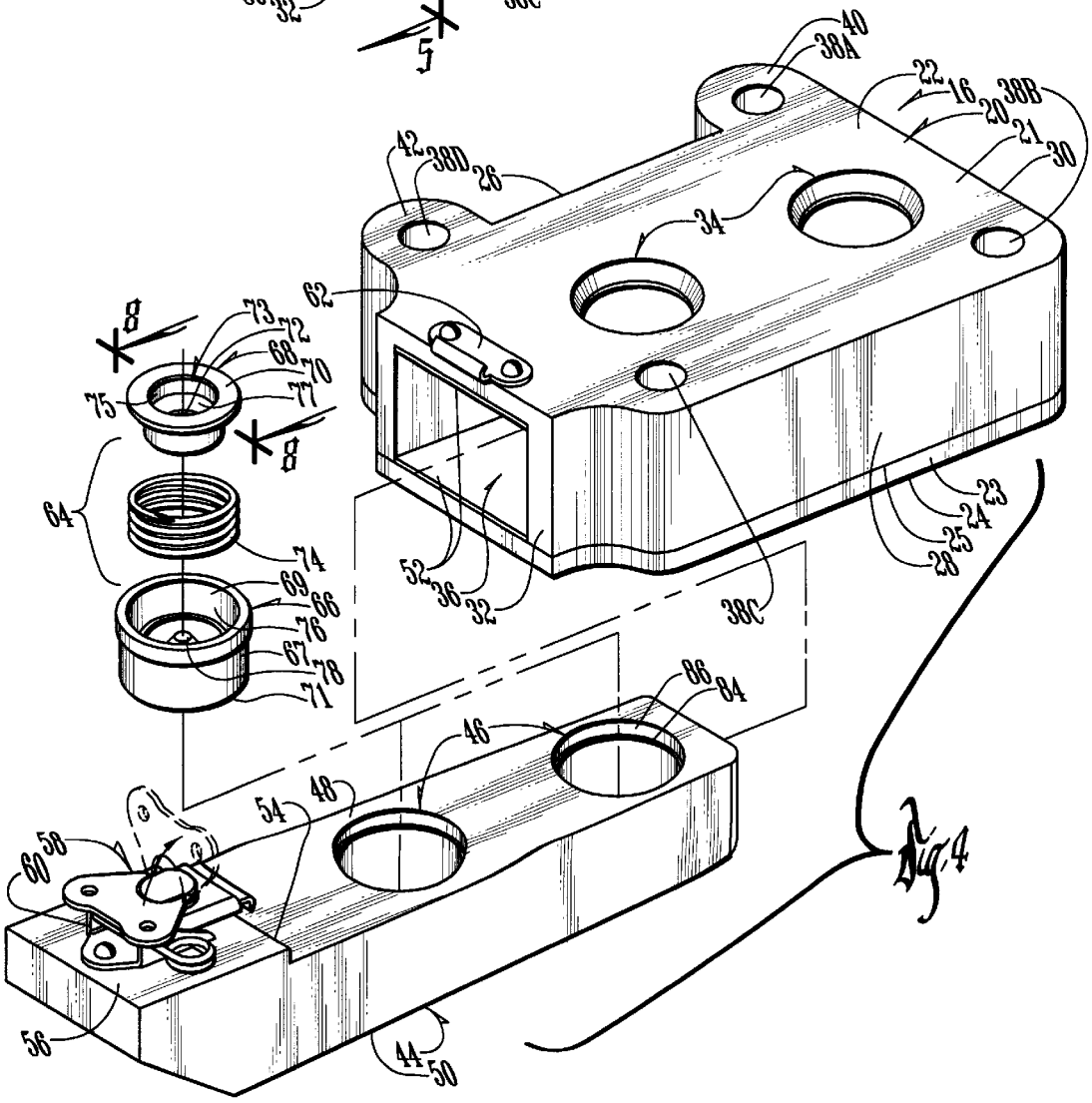
FIG. 4 is an exploded assembly view of the restrictor device of the present invention.

Referring to FIGS. 3 and 4, the restrictor device 16 has a body member 20 with preferably planar upper and lower surfaces 22, 24, opposite sides 26, 28, and opposite ends 30, 32. One or more fluid passages 34 extend through the body member 20 from top to bottom. The number of fluid passages 34 generally corresponds to the number of barrels or exhaust ports in the carburetor 14. Two passages 34 appear in the figures to illustrate the concept. However, one skilled in the art can appreciate that other arrangements and numbers of passages (including passages to correspond to a four barrel carburetor) are possible. The shape of the body member 20 can vary to correspond to the shape of the lower part of the carburetor 14 and the upper portion of the engine intake manifold 18. An aperture 36 extends horizontally into the body member 20 from one of the ends 30, 32 and under each of the fluid passages 34. Preferably the aperture 36 forms a blind hole.

For ease of construction, the body member 20 can comprise a main body 21 and a cover plate 23 joined together along a seam 25 which coincides with the bottom edge of the aperture 36. However, the body member 20 can be constructed as a single piece without detracting from the present invention.

A plurality of bolt holes 38A–38D extend through the body member 20 so as to allow the restrictor device 16 to be mounted between the carburetor 14 and the engine intake manifold 18 with bolts 39 as shown in FIG. 2. The bolt holes 38A and 38D have flanges 40, 42 respectively extending partially therearound (FIGS. 3 and 4).

Figure 4A:
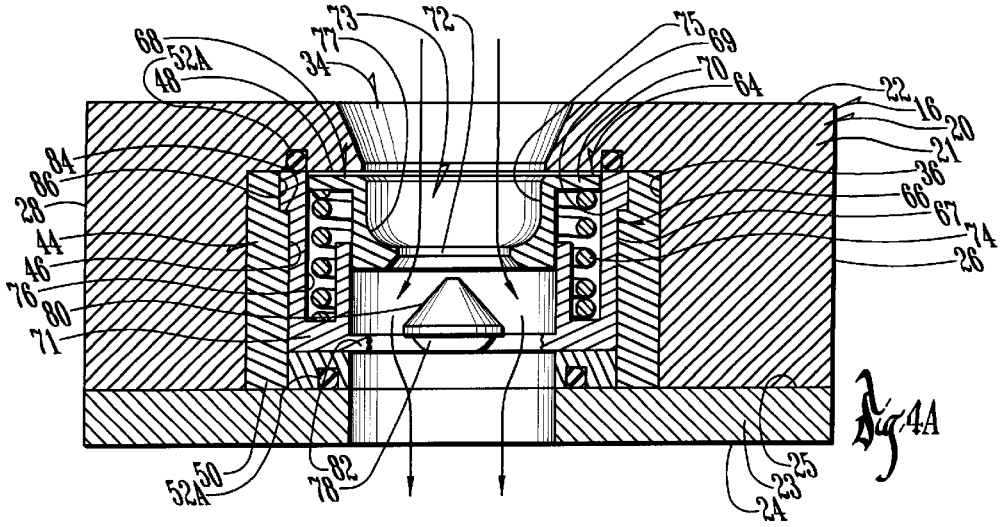
FIG. 4A is a cross-sectional view of the restrictor device similar to FIG. 5, but shows an alternative embodiment of the present invention which utilizes an O-ring and groove arrangement for sealing.

A restrictor plate 44, which includes a plurality of bores 46 extending therethrough, slidably inserts into the aperture 36 as shown in FIGS. 3 and 4. The restrictor plate 44 includes upper and lower substantially planar surfaces 48, 50. Sealing means 52 are operatively interposed between the upper and lower surfaces 48, 50 and the inner adjacent walls of the aperture 36 of the body member 20. The sealing means can comprise a gasket 52, as shown in FIG. 4, or other suitable means such as an O-ring and groove arrangement 52A (FIG. 4A) and the like so long as they fully circumscribe the bores 46 and the passages 34. In the figures, the bores 46 are shown to correspond closely to the size of the passages 34, however, it is contemplated that, because the restrictor plate is removably interposed between the passages 34, the bores 46 could be larger or smaller in diameter than the passages 34. In fact, such flexibility provides one of the advantages of the present invention. Larger bores 46 can accommodate larger orifices and therefore allow the engine intake 18 to draw more fuel. The racer can accelerate to a given speed more quickly.

The upper surface 48 of the restrictor plate 44 includes a step 54 outwardly adjacent to the bores 46. This step 54 defines an elevated surface 56 for mounting a retaining means 58. One of the blind holes or apertures 36 and the step 54 acts as a stopping means for limiting the depth to which the restrictor plate 44 can be inserted in the body member 20. This also insures the proper alignment and registration of the bores 46 with the fluid passages 34.

The retaining means 58 comprises a spring loaded latch having a bar portion 60 mounted on the elevated surface 56 and a catch portion 62 mounted on the upper surface 22 of the body member 20. The retaining means or latch 58 holds the restrictor plate 44 in place after it has been inserted into the body member 20. The latch 58 is opened and closed by raising the handle and turning it clockwise or counterclockwise. Of course, one skilled in the art will appreciate that the placement and the specific type of retaining means can be varied without detracting from the present invention.

Figure 5:
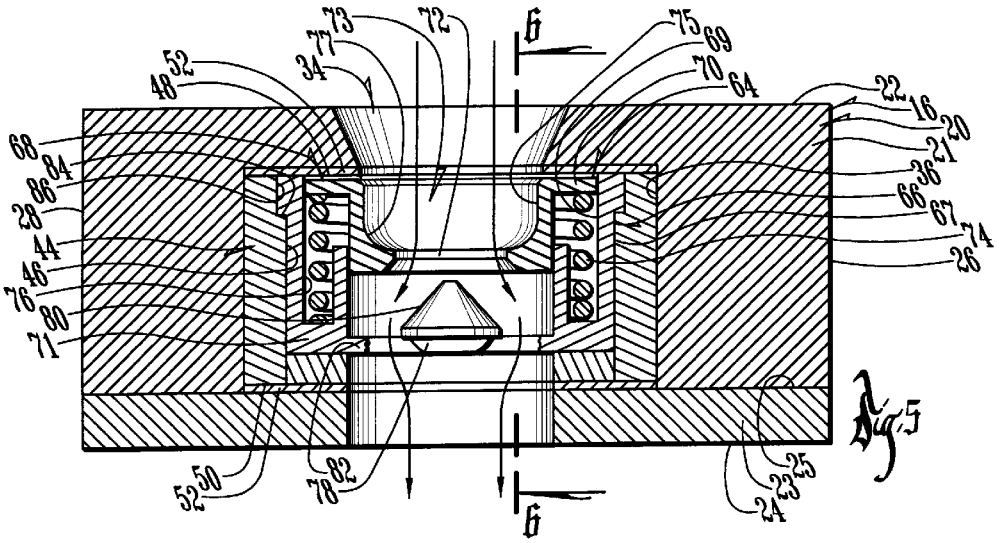
FIG. 5 is an enlarged cross-sectional view taken along line 5—5 in FIG. 3.
Figure 6:
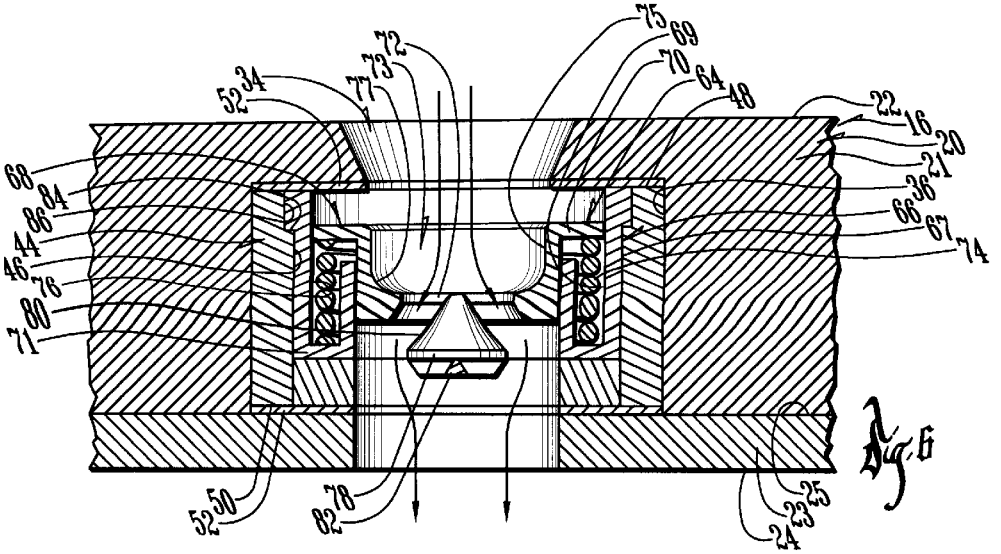
FIG. 6 is an enlarged cross-sectional view which is taken along line 6—6 in FIG. 5 and shows the response of the variable orifice of this invention to a demand for increased air flow.

Referring to FIGS. 4–6, an automatic variable orifice 64 is inserted in each of the bores 46 of the restrictor plate 44. The automatic variable orifice 64 includes a sleeve 66 and a washer member 68. The washer 68 is cup-shaped and has an outwardly directed flange 70 and a central fixed orifice 72. A spring 74 is mounted between the sleeve 66 and the washer 68. In the preferred embodiment the spring 74 is a coil compression spring. Multiple, stacked, or nested springs are also contemplated. Preferably the sleeve 66 has a J-shaped cross-section that includes an elongated outer portion 67, a truncated inner portion 69 and a lower portion 71 connecting the inner and outer portions to define an annular gap therebetween for receiving the spring 74.

In the embodiment shown in FIG. 4, a poppet 78 is suspended in the middle of the lower portion of the sleeve 66. As best seen in FIGS. 5 and 6, the poppet 78 has a conical portion 80 projecting upwardly toward the orifice 72 of the washer member 68. The poppet 78 mounts to the sleeve by one or more support members 82. The support member 82 can be welded or otherwise suitably attached to the poppet 78 and the sleeve 66, but the number and size of support members should be kept to a minimum so as to avoid unduly restricting the fluid flow through the passages 34. The preferred embodiment includes two support members 82 diametrically opposed to one another.

The upper end of the sleeve 66 has a flange 84 which protrudes radially outward. The flange 84 cooperates with a counterbore 86 in the bore 46 to limit the downward movement of the sleeve 66 within the bore 46. As best seen in FIG. 5, the upward movement of the sleeve 66 is limited by the body member 20 when the restrictor plate 44 is inserted.

Figure 7:
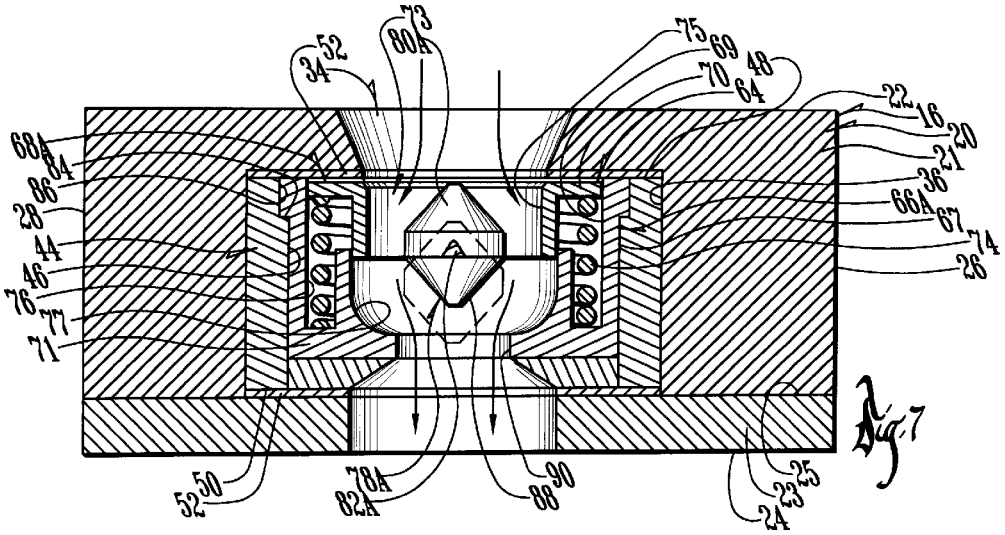
FIG. 7 is a cross-sectional view of another embodiment of the present invention wherein the poppet of the variable orifice is mounted to the washer.

FIG. 7 shows another embodiment of the present invention wherein the poppet 78A is attached by a plurality of support members 82A to the washer member 68A instead of the sleeve 66A. The poppet 78A then moves in conjunction with the washer member 68A. In addition to the upper conical portion 80A, the poppet 78 of this embodiment has a lower conical portion 88A which extends downwardly toward the bottom of the sleeve 66. A hole 90 at the bottom of the sleeve 66A serves as a fixed orifice which is made variable by the protrusion of the lower conical portion 88 thereinto. See the poppet position shown by dashed lines in FIG. 7.

Figure 8:
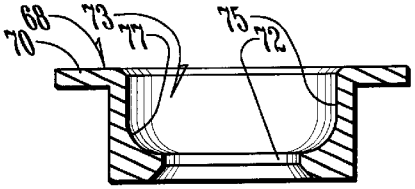
FIG. 8 is a cross-sectional view of the flow-responsive washer member of the restrictor device of FIGS. 4–6.

FIG. 8 shows the washer member 68 of FIGS. 5 and 6 in cross-section. The washer member 68 has an inside diameter 73 which has a straight upper portion 75 and a curved lower portion 77. The curved lower portion 77 extends upwardly and outwardly between the orifice 72 and the straight portion 75 without turning downward.

Figure 7A:
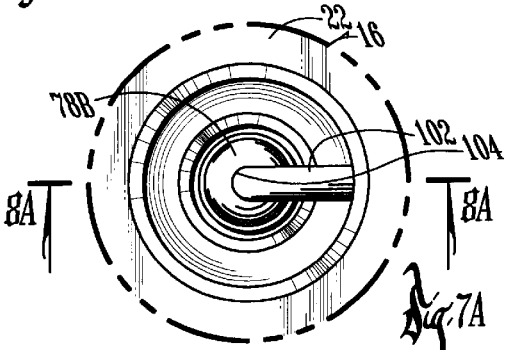
FIG. 7A is a top view of an alternative embodiment of variable orifice this invention in which a tension spring movably suspends the popper over the orifice opening.
Figure 8A:
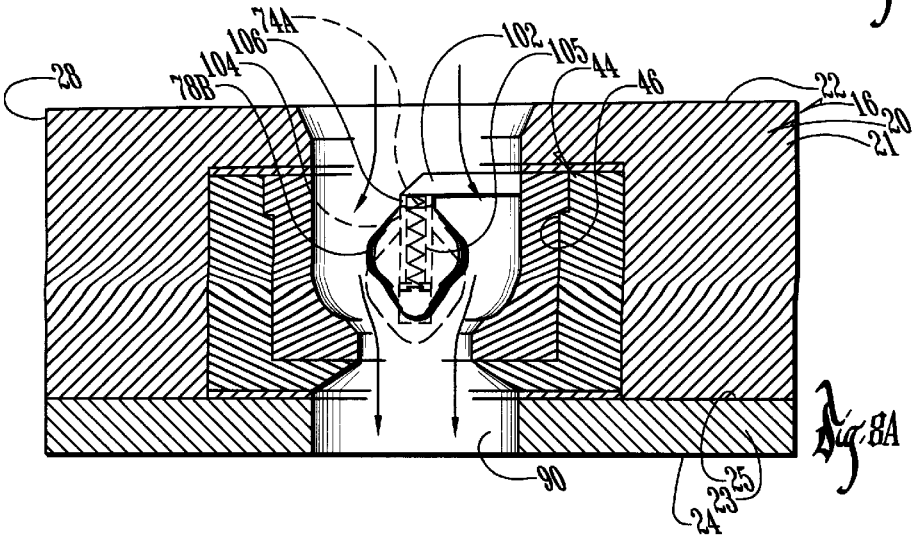
FIG. 8A is a cross-sectional view of the variable orifice taken along line 8A—8A of FIG. 7A.

FIG. 7A and 8A show an alternative embodiment of the variable orifice in which a tension spring 74A suspends a poppet 78B above the fixed orifice 90 from a cantilevered spring guide beam 102. The fluid flow, as indicated by the arrows, forces the poppet 78B downwardly from the dotted line position to the solid line position where it decreases the available flow area at the orifice 90. The top of the poppet 78B has a hole 104 therein for slidingly receiving the vertical portion 106 of the spring guide 102. The spring 74 is housed in a hole 105 in the vertical portion 106 of the guide 102 and the hole 104 in the poppet 78B. Thus, it is protected from the fluid flow, contamination, and other environmental factors which the rest of the valve is subjected to.

Figure 9A:
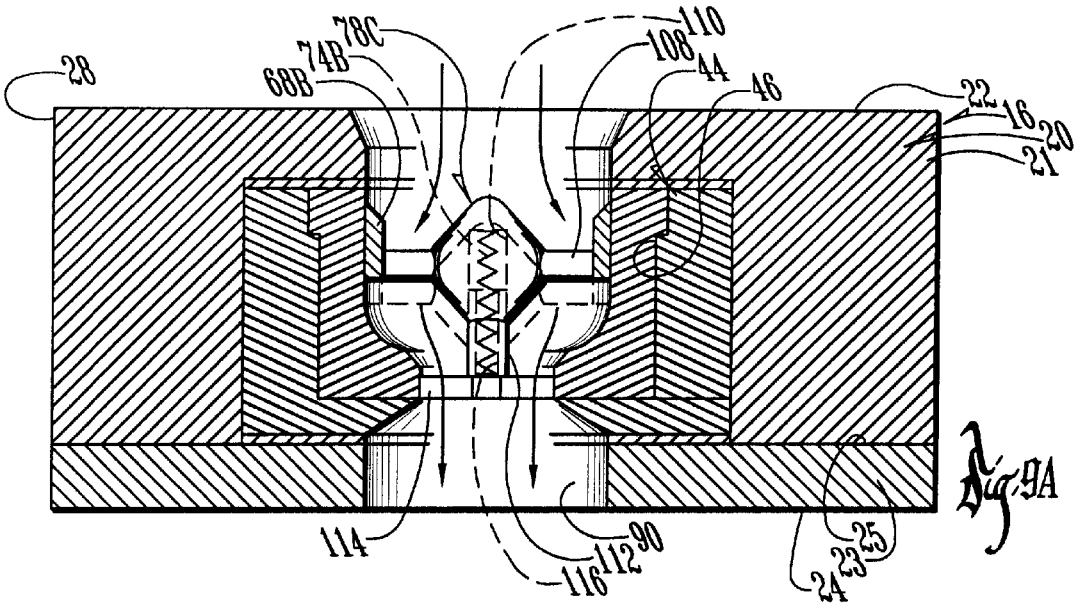
FIG. 9A is a cross-sectional view of another embodiment of the variable orifice of this invention in which a compression spring is operatively associated with the poppet.

FIG. 9A shows another embodiment in which a compression spring 74B is mounted inside a poppet 78C. The poppet 78C is suspended from a washer member 68B by a transverse support member 108. The poppet 78C has a vertical hole 110 in its lower portion for slidably receiving a stem 112 which is mounted in the sleeve 66B by a transverse support 114. The stem 112 includes a hole 116 for guidingly receiving the spring 74B. Again, the spring 74B is concealed.

In operation, the restrictor device 16 of the present invention automatically adjusts, varies, or restricts the fluid flow through the passages 34, as shown in FIGS. 5–7. FIG. 5 and the solid lines in FIG. 7 illustrate the position of the poppet 78 or 78A when the engine operates at relatively low speed or revolutions per minute (RPM), such as when idling or cruising. The fluid flow demanded by the engine intake is relatively small. Therefore, the pressure of the fluid flow upon the washer member 68 or 68A is insufficient to depress the spring 74. As indicated by the arrows in FIG. 5, the fluid flows through the orifice 72 of the washer member 68, then around the poppet 78, as it is drawn into the engine intake manifold 18 through the lower fluid passage 34. In this position, the flow of fluid to the intake manifold is essentially unrestricted by the device 16. In FIG. 7, the arrows indicate that fluid flows essentially unrestricted around the poppet 78A and through the orifice 90 into the intake manifold 18.

When the driver depresses the accelerator, additional fluid is demanded by the engine to reach the desired rpms. The increased fluid flow acts on the washer 68 (FIG. 6) or 68A (FIG. 7) to force it downwardly against the bias of the spring 74. Initially there may be little restriction of the flow until the conical portion 80 (FIG. 6) or 88 (FIG. 7) of the poppet 78 or 78A begins to impinge on or obstruct the orifice 72 (FIG. 6) or 90 (FIG. 7). Once impingement begins, additional flow demand will depress the washer 68 or 68A and further decrease the opening area of the variable orifice 64. The poppet 78 or 78A now substantially restricts the flow of fluid through the passage 34. As flow demand increases, the washer member 68 or 68A eventually strikes the sleeve 66 or 66A and the fluid flow reaches its predetermined maximum limit. Thus, all engines uniformly equipped with the device of the present invention will have identical maximum fuel intake capabilities regardless of other engine variables.

In general, it will be noted that the embodiment of FIG. 7 operates similar to the embodiment of FIGS. 5 and 6. The fluid flow moves the poppet into the orifice against the bias of the spring to vary the effective area of the orifice. However, the poppet 78A is attached to the washer 68A rather than the sleeve 66A. As increased flow is demanded by the engine, the poppet 78A moves downwardly with the washer 68A. Eventually, the lower portion 88 of the poppet 78A makes the fixed orifice 90 variable by changing the effective opening area of the orifice. The variable orifice 64 regulates the fluid flow provided to the engine through the bore 46.

The restrictor device 16 can be used to control the fluid flow available for an engine. The invention is particularly useful in modifying racing vehicles to bring about engine performance parity and improve the competitiveness of the race. For example, in the sport of automobile racing, a body member 20 can be installed in each vehicle before the race. Shortly before the race, preferably on the day of the race or immediately before the race, race officials give each competitor an identical restrictor plate 44 equipped with a preselected set of variable orifices. The race officials or the racing teams insert the restrictor plate 44 into the body member 20 previously installed on each race car.

Thus, each competitor is equally handicapped by being provided with identical automatic variable orifices. Each vehicle will have substantially identical engine performance. The racing teams would be unable to adjust to the particular restrictor plate 44 and orifices 64 chosen for that particular race. The racing teams with considerable financial and human resources would be unable to circumvent such restrictions on short notice. Therefore, the driving skill of the competitors and other factors would be more significant than the performance of their engines, which is substantially equalized with the device of the present invention.

It is also contemplated that the restrictor device could be applied as a handicap or as a penalty to a single vehicle or subset of the vehicles involved in the race. A fixed or variable orifice can be installed to restrict the flow of fluid into the engine intake of the subject vehicles. Thus, the subject vehicles would be penalized.

Fixed orifices can also be provided in the interchangeable restrictor plate. These detachably mounted fixed orifice restrictor plates would be provided to the racers shortly before the race starts. This would be a significant improvement over conventional noninterchangeable fixed orifices which currently require removal of the carburetor for changeovers. It would also require greater driving skill to recognize and adapt to the orifice issued if the orifice size were selected randomly from among several possible sizes.

An identical fixed orifice can provide an equal opening area for each engine, but this alone does not ensure a competitive race. Higher performance engines can accelerate faster because they draw more fuel through the orifice. However, use of identical variable orifices actually penalizes the higher performance engines because such engines attempt to draw more fuel mixture through the orifice, which causes the variable orifice to close even more.

The restrictor device 16 is extremely flexible in that the spring rate of the spring 74 can be selected so as to provide the desired response from the automatic variable orifice 64. Single, stacked, or nested springs can be utilized. A higher spring rate provides a slower flow restricting response than a lower spring rate. The spring also reacts to the acceleration of the vehicle. Abrupt acceleration of the engine causes an abrupt increase in fluid flow demanded. The increase in fluid flow demanded rapidly depresses the washer member 68 and thereby causes the poppet 78 to restrict the flow of fluid to the orifice. The conical shape of the poppet 78 means that a relatively small linear movement of the poppet causes a large percentage change in the effective size of the annular orifice. The restrictor device 16 of the present invention affects both the maximum fluid flow allowed and the maximum rate of change in the fluid flow demanded. Thus, the restrictor device 16 affects both the maximum speed and acceleration of the race car 10.

It is also contemplated that this device could be used to control the fluid flow intake of an engine such that the area of the orifice is inversely proportional to the fluid flow demanded. This can be accomplished by inverting the conical shaped poppet. Fluid flow to the engine intake would be greater at higher rpms and acceleration rates.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A device for automatically adjusting fluid flow into an engine intake, comprising:

a body member adapted to mount upstream of the engine intake, the body member having a fluid passage therethrough and an aperture therein intersecting the fluid passage;

a plate slidably insertable into the aperture in the body member and having a bore therethrough corresponding to and registerable with the fluid passage when the plate is inserted in the body member;

a variable orifice disposed in the bore having an orifice area which is automatically variable and dependent on demand for fluid by the engine intake at a given RPM.

2. The device of claim 1 wherein the orifice area is inversely proportional to the fluid flow through the orifice area once the fluid flow reaches a predetermined value.

3. The device of claim 1 wherein the variable orifice comprises a sleeve mounted in the bore, a washer member mounted in the sleeve and having a central opening therein, a spring mounted between the sleeve and the washer member, and a poppet mounted to one of the sleeve and washer member so as to be disposed in a path of fluid flow through the device.

4. The device of claim 3 wherein the sleeve has an annular recess.

5. The device of claim 3 wherein the poppet is mounted to the sleeve.

6. The device of claim 3 wherein the poppet is mounted to the washer member.

7. The device of claim 3 wherein the washer member is cup-shaped.

8. The device of claim 3 wherein the spring means has a predetermined spring rate which determines a rate of change in the opening area of the variable orifice.

9. The device of claim 1 wherein the plate includes a plurality of the variable orifices therein and the body member includes a corresponding plurality of fluid passages therethrough which register with a corresponding plurality of barrels in a carburetor.

10. The device of claim 1 wherein the plate has upper and lower surfaces and sealing means are interposed between the upper and lower surfaces of the plate and the body member respectively.

11. The device of claim 1 wherein the body member is mounted between the carburetor and the engine intake.

12. The device of claim 1 wherein the body member is adapted to mount in covering relation to the engine intake.

13. A device for automatically adjusting fluid flow into an engine intake from a carburetor, comprising:

a restrictor plate adapted to be mounted between the carburetor and the engine intake and having a bore therethrough in fluid communication with the carburetor and the engine intake;

an automatically variable orifice disposed in the bore;

the variable orifice comprising a washer member having an orifice therethrough and a poppet member registered with the orifice, one of the poppet member and washer member being movable in response to demand for fluid flow such that the poppet member protrudes into the orifice and thereby defines an effective orifice area between the washer member and the poppet member that is dependent on fluid flow demanded.

14. The device of claim 13 comprising a spring mounted between the poppet member and the washer member.

15. The device of claim 13 wherein the poppet is elongated and has a portion proximate the orifice, the proximate portion has opposite ends and a transverse cross-sectional area which increases uniformly from one end to the other end.

16. The device of claim 13 wherein the restrictor plate is detachably mounted between the carburetor and the engine intake and can be inserted and removed without tools.

17. A method of controlling the engine performance of a first racing vehicle, the racing vehicle having an engine with a carburetor and an engine intake downstream of the carburetor, comprising:

a) mounting a body member between the carburetor and the engine intake, the body member having a fluid passage therethrough adapted to be in communication with the carburetor and the engine intake, the body member having a transverse aperture therein intersecting the fluid passage;

b) inserting a restrictor plate into the aperture of the body member in the racing vehicle, the restrictor plate having a first variable orifice disposed therein registered with the fluid passage in the body member;

c) automatically adjusting the size of the variable orifice in response to fluid flow demand so as to control engine performance by controlling fluid flow through the fluid passage into the engine intake.

18. The method of claim 17 further repeating steps a–c on a plurality of additional racing vehicles scheduled to race with the first racing vehicle, thereby achieving substantially identical engine performance in each respective racing vehicle during the race.

19. The method of claim 18 wherein the engine performance of a subset of racing vehicles is reduced relative to the other racing vehicles.

20. The method of claim 19 wherein the subset of racing vehicles comprises a single racing vehicle.

* * * * *